United States Patent [19]

Schrecongost et al.

[11] 4,043,244

[45] Aug. 23, 1977

[54] ELECTRONIC MUSICAL INSTRUMENT KEYBOARD

[75] Inventors: Ray B. Schrecongost, Park Ridge; Edward J. Perutis, Chicago, both of Ill.

[73] Assignee: Hammond Corporation, Chicago, Ill.

[21] Appl. No.: 532,427

[22] Filed: Dec. 13, 1974

Related U.S. Application Data

[63] Continuation of Ser. No. 476,971, June 6, 1974, abandoned, which is a continuation of Ser. No. 339,628, March 12, 1973, abandoned.

[51] Int. Cl.[2] ..... G10C 3/12

[52] U.S. Cl. ..... 84/423; 84/434; 84/439

[58] Field of Search ..... 84/423–440; 264/249

[56] References Cited

U.S. PATENT DOCUMENTS

| | | | |
|---|---|---|---|
| 2,562,471 | 7/1951 | Martenot | 84/423 |
| 2,567,870 | 9/1951 | Bozak et al. | 84/433 X |
| 2,612,812 | 10/1952 | Greenleaf et al. | 84/423 X |
| 2,705,346 | 4/1955 | Schlabach et al. | 264/249 |
| 2,832,251 | 4/1958 | Hayslett | 84/433 |
| 3,308,225 | 3/1967 | Wells | 264/249 |
| 3,480,744 | 11/1969 | Yamada | 84/433 X |
| 3,705,380 | 12/1972 | Roberts | 264/249 X |
| 3,754,319 | 8/1973 | Miori | 264/249 X |

FOREIGN PATENT DOCUMENTS

| | | | |
|---|---|---|---|
| 21,326 | 8/1970 | Japan | 84/423 |

*Primary Examiner*—Lawrence R. Franklin

*Attorney, Agent, or Firm*—Neuman, Williams, Anderson & Olson

[57] ABSTRACT

A musical instrument keyboard consisting of a spring metal plate stamped into the shape of a comb with the back of the comb clamped in position and the teeth thereof mounting the keys, characterized by low cost, and including provision for comparable pressure of operation as between the long lever (white) keys and the short lever (black) keys, and requiring no soft side guides or the hardware to mount them.

10 Claims, 3 Drawing Figures

ELECTRONIC MUSICAL INSTRUMENT KEYBOARD

This is a continuation of application Serial No. 476,971 filed June 6, 1974, which is a continuation of application Ser. No. 339,628 filed Mar. 12, 1973, both now abandoned.

BACKGROUND OF THE INVENTION

A keyboard for electronic instruments is basically a series of switches, one for each note over the desired number of chromatic octaves. Hitherto, each key has been separately mounted to a frame and separately adjusted with respect to its neighboring keys, demanding a large number of separate parts and separate assembly operations. Also, spacers have been found necessary to maintain the separation and parallelism of the keys which, with time, frequently cause noisiness of operation and a rubbing or loosening of the keys.

SUMMARY OF THE INVENTION

This invention contemplates a keyboard constructed of spring metal combs formed of a sheet spring metal with the teeth thereof well separated, each tooth being identified with a note of the scale. The backs of the combs are clamped horizontally in a line with the teeth projecting toward the front of the instrument or toward the performer in conventional style. One or more switches underlies each tooth to be operated thereby and the teeth associated with the black keys —the short lever keys— are weakened at their bases to equalize the effort of operation. The teeth are thin and wide. Thus, they yield readily in the up-and-down mode but are rigid to side-to-side pressures, and spacers or separators are wholly avoided. The comb and keys lend themselves to fixture emplacement of assembly, producing a highly accurate key array.

DESCRIPTION OF A PREFERRED EMBODIMENT

Figure 1:
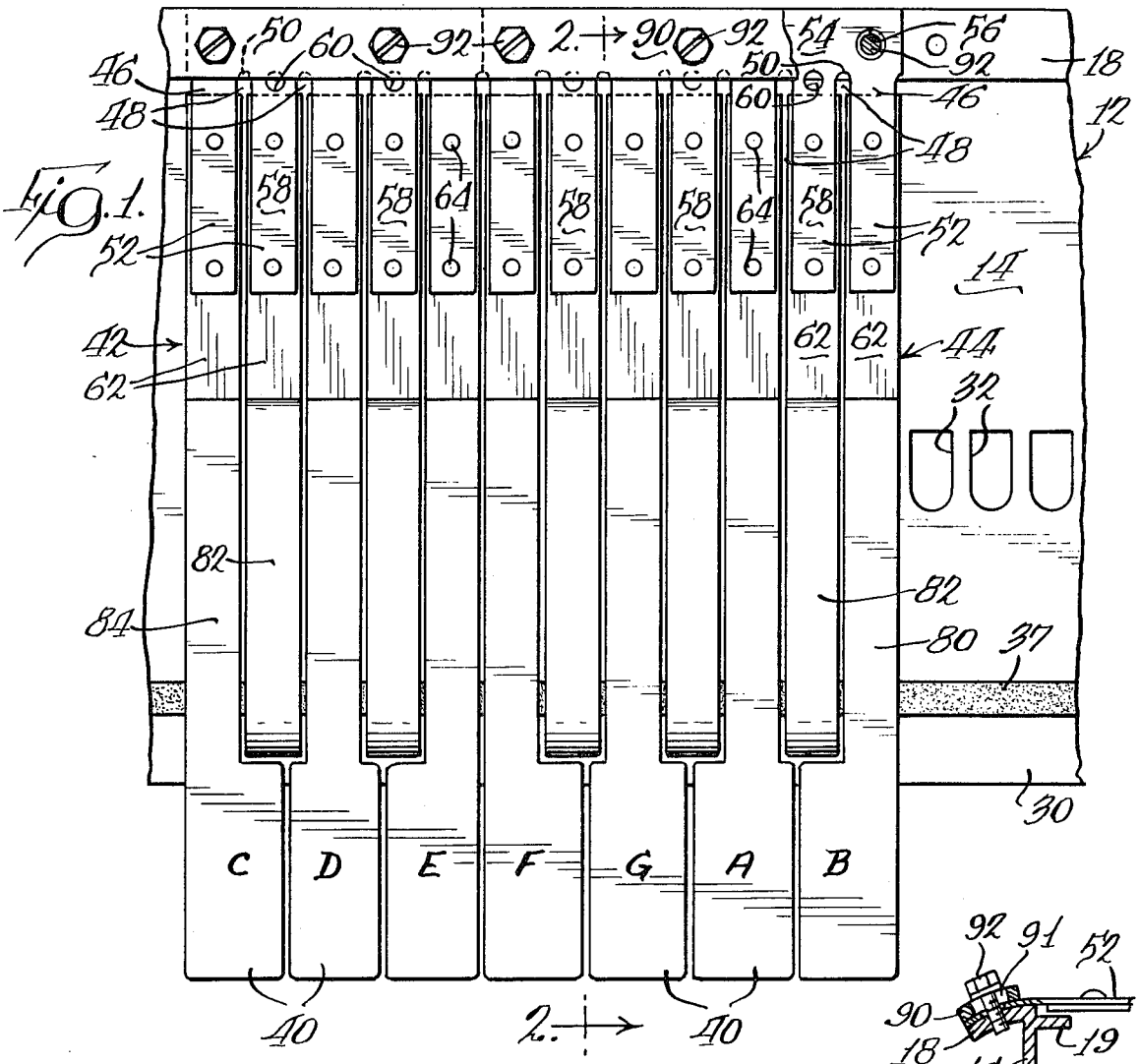
FIG. 1 is a top plan view of a portion of a keyboard embodying this invention.
Figure 2:
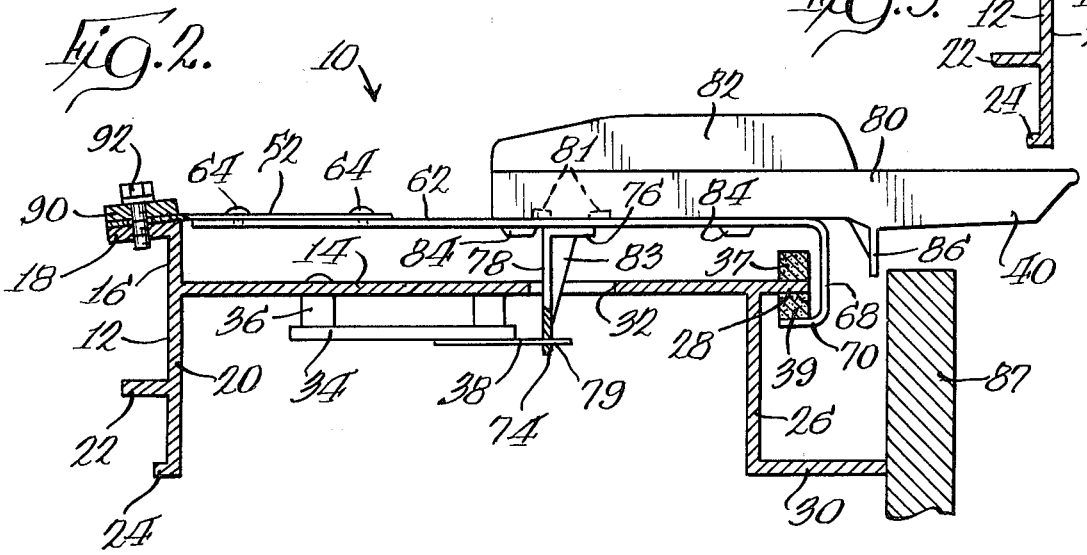
FIG. 2 is a section through the keyboard of FIG. 1 taken along the line 2—2 of FIG. 1 looking in the direction of the arrows.

The keyboard 10 of the present invention is assembled on an extruded aluminum plate or frame 12 which, in cross section, includes a flat horizontal web 14 having an upstanding flange 16 on its back edge with a downwardly and backwardly inclined key mounting rail 18 extending from the top edge thereof. The angle of inclination of the rail 18 is illustratively on the order of 6° for purposes to be made clear later. The flange 16 continues below the central web 14 as at 20 from which ribs 22 and 24 project backwardly. Toward the forward edge of the extrusion, a second dependent flange 26 is formed backward from the free edge of the web 14 so that the free edge forwardly of the flange defines a lip 28. Flange 26 terminates in a forwardly extending rib 30.

The web 14 has a longitudinal series of apertures 32 formed therein, one for each key of the keyboard. Switch boards 34 are mounted to the under side of the web 14 by spacers 36 and have switch fingers 38, one for each key, underlying the apertures 32. The extrusion ribs 22, 24 and 30 are for mounting the keyboard within the instrument itself and do not concern this invention. The lip 28 has felt strips adhesively secured to the top and bottom surfaces thereof which constitute, respectively, a down-stop 37 and an up-stop 39.

The keys 40 themselves are formed in clusters of five and seven keys with an eight-key cluster (not shown) to complete the top octave. A representative keyboard will have 61 keys covering five octaves beginning and ending at C. Thus, the keys of notes C through E constitute the five-note clusters 42 and the keys for notes F through B constitute the seven-note clusters 44. The eight-key cluster will be identical with the seven-key cluster with the additional presence of the high C of the keyboard. This particular division of the octaves into the specific clusters is somewhat arbitrary but has the advantage that adjacent clusters terminate at adjacent white notes and thus make gauging the parallelism of adjacent clusters easier. Octave clusters are readily conceivable and within the purview of this invention but replacement costs in the event of a broken or defective key run high in such case.

The clusters 42 and 44 are essentially identical except for the number of keys concerned. They consist of a comb 46 formed from a rectangular sheet of thin spring steel by parallel slits 48 extending perpendicularly in from one edge of the plate to a point 50 approaching the opposite edge, so defining spring fingers 52 and a back 54. The spring fingers are short and account for only a small proportion of the total length of the key. The width of the slits 48 is such as to effect an appreciable separation between the fingers. The back has mounting holes 56 formed therein. At the root of those fingers 58 which carry the black keys, the cross section is reduced by the formation of a hole 60 to weaken the spring.

As illustrated, a key support 62 consisting of a relatively thick, rigid strip of metal has extruded half-shear dowels 64 formed in the back end thereof extending through like located holes in the spring fingers 52 which are headed over to attach the supports to the spring fingers, the supports thus constituting longitudinal extensions of the fingers. The key supports may also be attached by spot welding. The supports should approach closely the back 54 of the comb 46. The supports are of about the same width as the spring fingers so as again to leave a comfortable avoidance space between them. At that end remote from the point of attachment to the spring fingers, the supports terminate in a downwardly extending, recurved channel section or bracket 68 providing a reversely oriented horizontal lip 70. The bracket 68 defined by the lip 70 and the shank 62 of the support opposite the lip determines, in cooperation with the down stop 37 and up stop 39, the travel of the key.

A molded switch actuator 74 is attached to the under side of the support 62 to extend downwardly therefrom. It is an L-shaped molding with the short leg 76 thereof mounted against the under side of the support and the long leg 78 thereof extending perpendicularly downward. The long leg has a window 79 therein through which the switch blade 38 extends. Two integral hooks 81 are formed on the outside of the short leg 76 and are snapped into appropriate holes in the support 62 to mount the actuator to the support. A gusset 83 extends between the legs 76 and 78.

The keys 80 and 82 proper are plastic moldings secured to the tops of the supports. Each of the keys is provided with a pair of studs 84 on their bottom surfaces which extend through appropriate holes in the supports 62 and are ultrasonically or thermally staked in a fixture to secure the keys firmly to the brackets and accurately control their spacing. The white keys 80 overhang the ends of the supports 62 substantially and include a downwardly extending integral flange 86 toward their outer ends outwardly of the bracket 68 to be lapped behind the front rail 87 of the instrument for a conventional finished appearance.

The above assembly of the plastic keys to the key supports is a feature of considerable consequence. The keys are placed in a fixture in inverted relation which holds them to an exact spacing and parallelism, and the comb and key support assemblies are placed on the exposed studs for the staking. Ultrasonic staking plasticizes the studs as does direct thermal staking so that the studs will distort to the needed degree to maintain the spacing and parallelism imposed by the fixture despite minor deviations from exactness in the location of the studs or in the key support holes receiving the studs. Even though these deviations might be insufficient to cause interference as between keys, they would provide a poor appearance. The fixtured thermal or ultrasonic staking produces a superior keyboard in appearance, at least.

The assembly of the keyboard will be readily understood from the foregoing description. The key clusters, consecutively, will be lowered toward the plate 12 well forward of their final position such that the switch actuators enter the forward end of the apertures 32. The key clusters are then moved backward so that the windows in the switch actuators 74 slip over the ends of the switch fingers 38.

At the same time, the bracket 68 is moved into embracing relation with the lip 28 and its attached up and down stops 37 and 39. The back 54 of the comb 46 is brought into registry with the downwardly angled rail 18. Rail 18 has bores therein with which the mounting holes 56 in the comb are designed to register. The mounting holes are desirably slightly oversized with respect to the bores. A clamping strip 90 having similarly arranged holes therein is placed over the back of the comb, and self-tapping screws 92 are inserted through the holes in the clamp strip, through the comb, and threaded into the bores in the rail 18. By virtue of the slight oversize of the holes 56 in the comb, the clusters may be adjusted to a minor degree to ensure a proper relation with the frame 12 and with each other. Screws 92 are then turned down tightly to clamp the back of the comb firmly. The clamping strips 90 may be individual to each of the key clusters or they may span two or more of them.

It is imperative that all keys have a certain positive resilient resistance to movement. It is to this end that the rail 18 is provided with its tilted surface. A permanent upward inclination is imposed on the spring fingers which is opposed by the engagement of the channel 68 with the up stop 39, so imparting a permanent upward bias to the keys.

Figure 3:
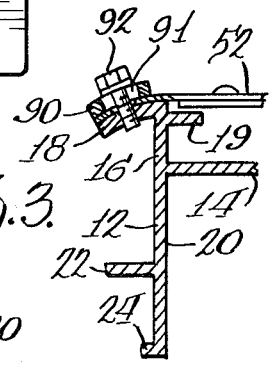
FIG. 3 is a section similar to the upper left hand portion of FIG. 2 illustrating certain optional provisions.

FIG. 3 illustrates optional features. In that figure, the rail 18, instead of being transversely straight is upwardly convex, extending initially substantially horizontally from the top edge of the flange 16 and curving downwardly and backwardly therefrom. The clamping strips 90, in this form, have a transverse downwardly concave curvature complementary to the curvature of the rail 18 and transverse slots 91 therein as compared with the circular holes of the first-described form.

By virtue of this construction, the clamping strips may be adjusted transversely up and down on the rail 18 as permitted by the slots 91 to impose a greater or less upward angle on the spring fingers with respect to the horizontal. Thus, the upward bias of the keys or the touch of the instrument may be adjusted.

The close approach of the key supports to the backs 54 of the combs 46 is to limit the area of hinging to a very short portion of the spring fingers between the rail 18 and the key supports, so minimizing the likelihood of twisting.

As shown in FIG. 3, the extruded frame may include additionally a horizontal rib 19 projecting forwardly from the flange 16 a short distance below the top edge of the rail which also is directed to the problem of minimizing the likelihood of twisting.

It should be situated as close to the underside of the back ends of the key supports as feasibly possible without being contacted by the key supports in the course of key movement. So positioned, it will intercept the key supports and prevent twisting of the spring fingers in the event of a twisting moment applied to the key. The presence of the rib 19 and its positive prevention of twist makes possible the use of thinner spring stock for the combs which, in turn, permits a greater control of the touch of the instrument.

It is, of course, desirable that all keys, whether white or black, demand essentially equal pressure for operation. Since the white keys constitute a longer lever arm than the black keys, the black keys would be noticeably more difficult to operate than the white keys in the absence of the reduction of section provided by the holes 60 at the root thereof. This reduction of section, obviously, could be achieved in other ways as by notching out the sides of the spring fingers on the root lines thereof.

We claim:

1. A key cluster for a musical instrument keyboard comprising a thin sheet of resilient material slit to define a plurality of spaced, parallel, relatively wide spring fingers, said fingers having black and white keys secured thereto to extend axially therefrom in chromatic order, the spring fingers associated with the black keys being formed with a smaller cross section over at least a portion of their length relative to that of the spring fingers associated with the white keys to equalize operating pressure as between the white and black keys, and means associated with each key for operating a switch.

2. The combination as claimed in claim 1 wherein said fingers are of substantially equal width and said smaller cross section is derived from a perforation formed in the root of said black key fingers.

3. A musical instrument keyboard assembly including means providing a mounting rail, a key cluster comprising a thin sheet of resilient material having slits extending from one edge toward the opposite edge thereof to define parallel, spaced, relatively wide spring fingers, black and white playing keys arranged in chromatic order mounted to each of said fingers to extend axially therefrom, the fingers associated with said black keys having a smaller cross section over at least a portion of their length to equalize operating pressure as between the black and white keys, said opposite edge of said sheet being secured rigidly against said rail, and means associated with each key for controlling a signal source.

4. The combination as set forth in claim 3 wherein said smaller cross section is derived from a perforation formed in the black key fingers in the area of flexure thereof.

5. A musical instrument keyboard assembly including a frame and a key cluster mounted on said frame, said frame including:

a. a key mounting rail angled downwardly from front to back; and b. an up-stop spaced from said rail; and key cluster including:

c. a key comb comprising a thin, substantially flat sheet of resilient material having slits therein extending from one edge toward an opposite edge to define parallel, spaced spring fingers and a mounting portion adjacent said fingers, said mounting portion being fastened rigidly against said key mounting rail; and d. a plurality of playing key assemblies each mounted on one of said spring fingers and including an up-stop bracket engaging said up-stop on said frame to define a restored position of said playing key assembly substantially short of complete resilient restoration of said spring finger, said up-stop bracket and said up-stop engaging each other to limit restoration of said spring fingers to a position short of parallel to said downward angle of said rail and wherein said frame further includes a rib generally parallel to said key mounting rail and extending partly under said spring at a point corresponding to about the line of maximum deflection thereof to substantially eliminate any torsional motion of said spring fingers.

6. A musical instrument keyboard assembly including a frame and a key cluster mounted on said frame, said frame including:

a. a key mounting rail angled downwardly from front to back; and b. an up-stop spaced from said rail; said key cluster including:

c. a key comb comprising a thin, substantially flat sheet of resilient material having slits therein extending from one edge toward an opposite edge to define parallel, spaced spring fingers and a mounting portion adjacent said fingers, said mounting portion being fastened rigidly against said key mounting rail; and d. a plurality of playing key assemblies each mounted on one of said spring fingers and including an up-stop bracket engaging said up-stop on said frame to define a restored position of said playing key assembly substantially short of complete resilient restoration of said spring finger said up-stop bracket and said up-stop engage each other to limit restoration of said fingers to a position short of parallel to said downward angle of said rail and wherein said spring fingers associated with black keys are formed with a smaller cross section over at least a portion of their length relative to that of the spring fingers associated with white keys to equalize operating pressure therebetween.

7. Apparatus as claimed in claim 6, wherein said fingers are substantially equal width and said smaller cross section is derived from a perforation in the root of said black key fingers.

8. A musical instrument keyboard assembly including means providing a mounting rail, a key cluster comprising a thin sheet of resilient material having slits extending from one edge toward the opposite edge thereof to define parallel, spaced, relatively wide spring fingers, black and white playing keys arranged in chromatic order mounted to each of said fingers to extend axially therefrom, said opposite edge of said sheet being secured rigidly against said rail, a flange extending from said mounting rail generally perpendicular to said fingers of said key cluster and having thereon a rib extending opposite said rail and situated under said fingers at about the line of maximum deflection thereof, and means associated with each key for controlling a signal source.

9. A musical instrument keyboard assembly including a keyboard frame having a rail generally inclined upwardly with respect to said frame, said rail having a transversely convex upper surface, a key cluster comprising a thin sheet of resilient material having slits extending from one edge toward the opposite edge thereof to define parallel spaced relatively wide spring fingers, black and white playing keys arranged in chromatic order mounted to consecutive ones of said fingers to extend axially therefrom, said opposite edge of said sheet being secured rigidly against said convex surface by a clamping member for urging said keys upwardly, said clamping member having a surface complementary to said convex rail surface and being transversely adjustable with respect to said rail surface, and interengaging means on said keys and said frame to limit resilient restoration of said keys.

10. A musical instrument keyboard assembly as claimed in claim 9 wherein said interengaging means includes an up-stop mounted on said frame and spaced from said rail and an up-stop bracket mounted on each of said playing keys, said up-stop bracket and said up-stop engaging each other to limit said resilient restoration of said keys.

* * * * *